US008212185B1

(12) United States Patent
Barron

(10) Patent No.: US 8,212,185 B1
(45) Date of Patent: Jul. 3, 2012

(54) HEATED GARMENT ASSEMBLY

(76) Inventor: Jerry Barron, Atlanta, GA (US)

( * ) Notice: Subject to any disclaimer, the term of this patent is extended or adjusted under 35 U.S.C. 154(b) by 523 days.

(21) Appl. No.: 12/557,919

(22) Filed: Sep. 11, 2009

(51) Int. Cl.
*H05B 1/00* (2006.01)
*H05B 3/36* (2006.01)

(52) U.S. Cl. ..... 219/211

(58) Field of Classification Search ..... 219/528–529, 219/211
See application file for complete search history.

(56) References Cited

U.S. PATENT DOCUMENTS 1,691,472 A 11/1928 Graham et al.
2,287,915 A 6/1942 Taylor
2,458,119 A 1/1949 Van Daam
4,404,460 A * 9/1983 Kerr ..... 219/211
5,032,705 A * 7/1991 Batcheller et al. ..... 219/211
5,302,807 A 4/1994 Zhao
5,777,296 A 7/1998 Bell
6,078,025 A 6/2000 Yeung
D429,058 S 8/2000 Derosier
D457,711 S 5/2002 Mahabir et al.
7,230,206 B1 * 6/2007 Randall ..... 219/211
* cited by examiner

*Primary Examiner* — Calvin Lee

(57) ABSTRACT

A heated garment assembly includes a jacket that includes a front panel and a rear panel integrally coupled together. The jacket has a neck opening and a body opening. The front panel has a slit therein extending between and through the neck and body openings. A pair of sleeves is attached to the jacket. The front and rear panels include an inner layer and an outer layer. A heat emitter is mounted in the jacket. The heat emitter includes a plurality of upper heating elements. The upper heating elements extend through the rear panel, the front panel and each of the sleeves. The upper heating elements are positioned between the inner and outer layers. A power supply is electrically coupled to the upper heating elements. A control is electrically coupled to the power supply to selectively turn the heating elements on or off.

4 Claims, 6 Drawing Sheets

FIG. 6
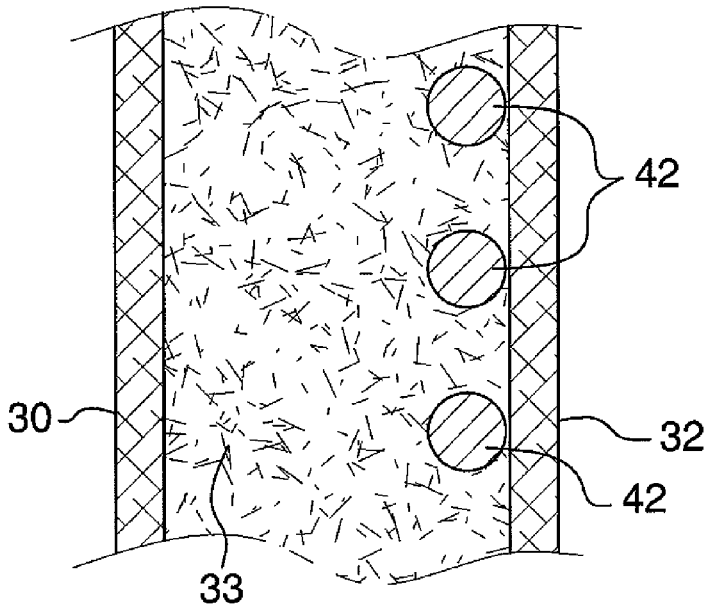
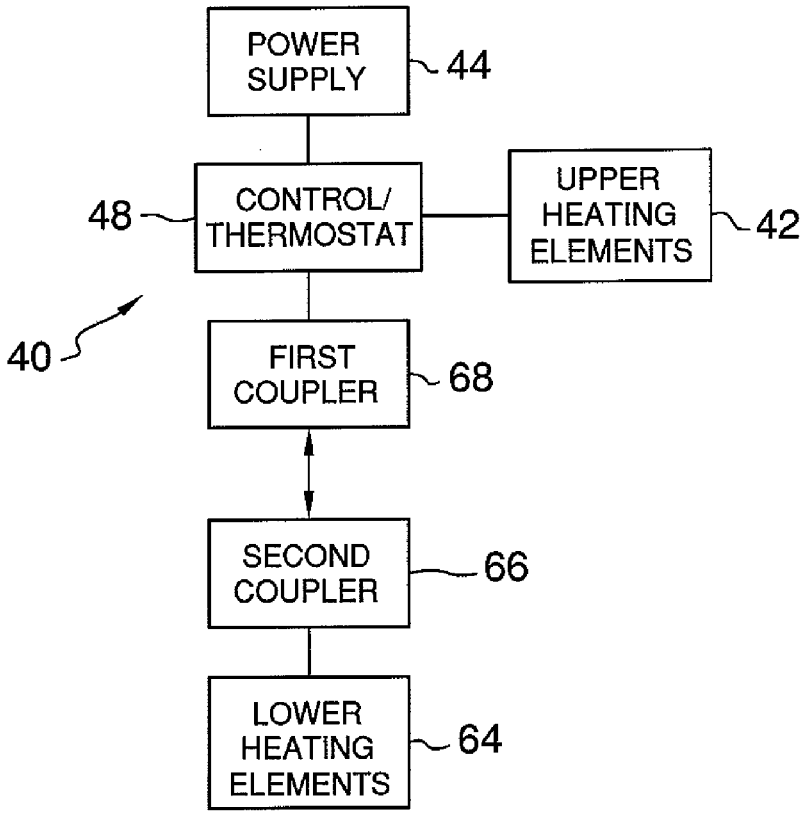
FIG. 7

HEATED GARMENT ASSEMBLY

BACKGROUND OF THE DISCLOSURE

Field of the Disclosure

The disclosure relates to heated garment devices and more particularly pertains to a new heated garment device for keeping a person's entire body warm while allowing free movement of the person wearing the garment.

SUMMARY OF THE DISCLOSURE

An embodiment of the disclosure meets the needs presented above by generally comprising a jacket that includes a front panel and a rear panel integrally coupled together. The front and rear panels each have an upper edge defining a neck opening and a lower edge defining a body opening. The front panel has a slit therein extending between and through the neck and body openings. A pair of sleeves is attached to the jacket and positioned on opposite sides of the jacket. The front and rear panels include an inner layer and an outer layer. A heat emitter is mounted in the jacket. The heat emitter includes a plurality of upper heating elements. The upper heating elements extend through the rear panel, the front panel and each of the sleeves. The upper heating elements are positioned between the inner and outer layers. A power supply is electrically coupled to the upper heating elements. A control is electrically coupled to the power supply to selectively turn the heating elements on or off.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein:

FIG. 6 is a cross-sectional view of an embodiment of the disclosure taken along line 6-6 of FIG. 2.

FIG. 7 is a schematic view of an embodiment of the disclosure.

DESCRIPTION OF THE PREFERRED EMBODIMENT

Figure 1:
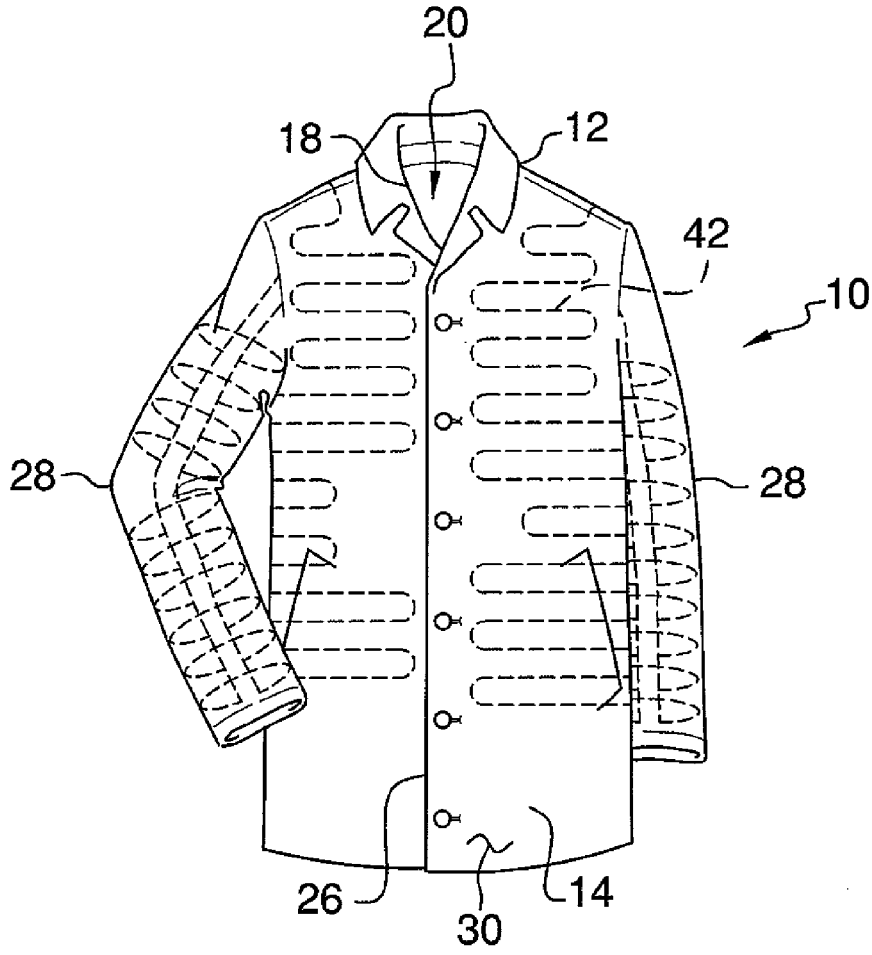
FIG. 1 is a front view of a heated garment assembly according to an embodiment of the disclosure.
Figure 2:
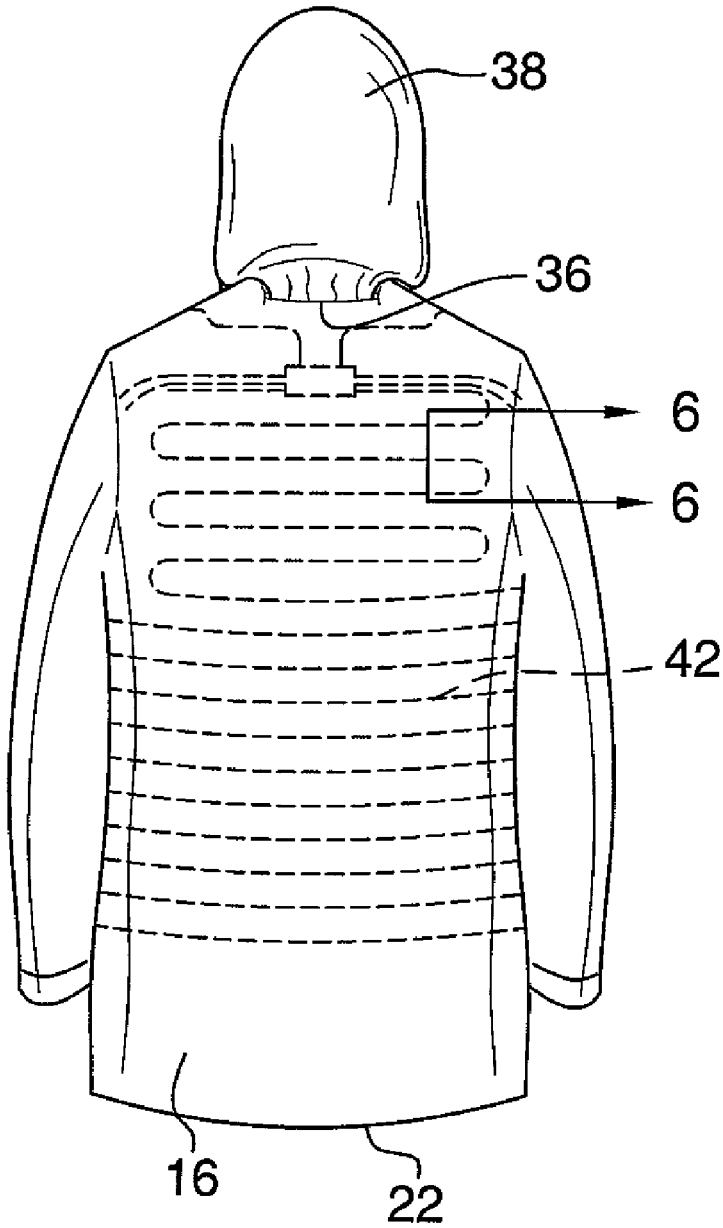
FIG. 2 is a rear view of an embodiment of the disclosure.
Figure 3:
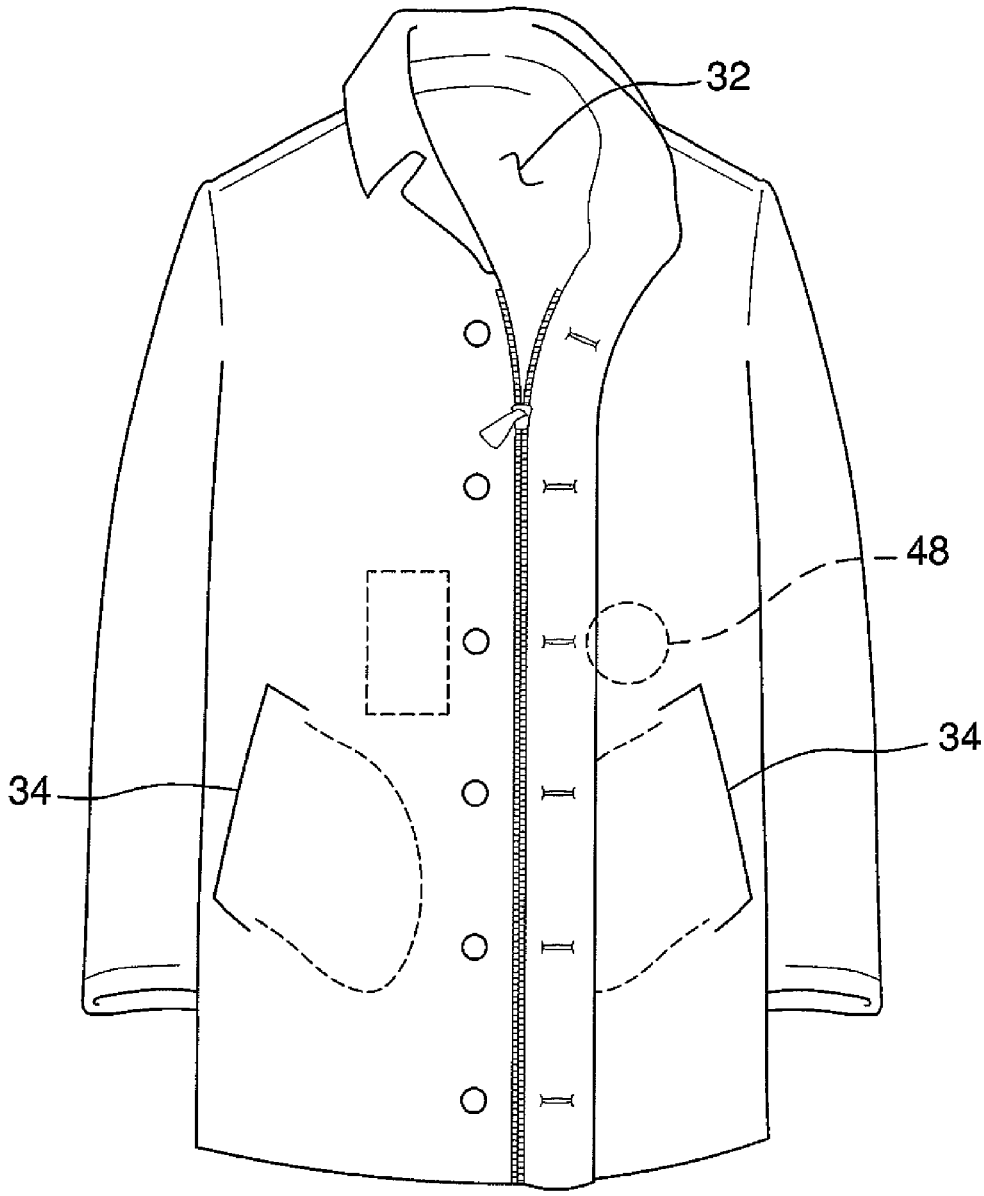
FIG. 3 is a front perspective view of an embodiment of the disclosure.
Figure 4:
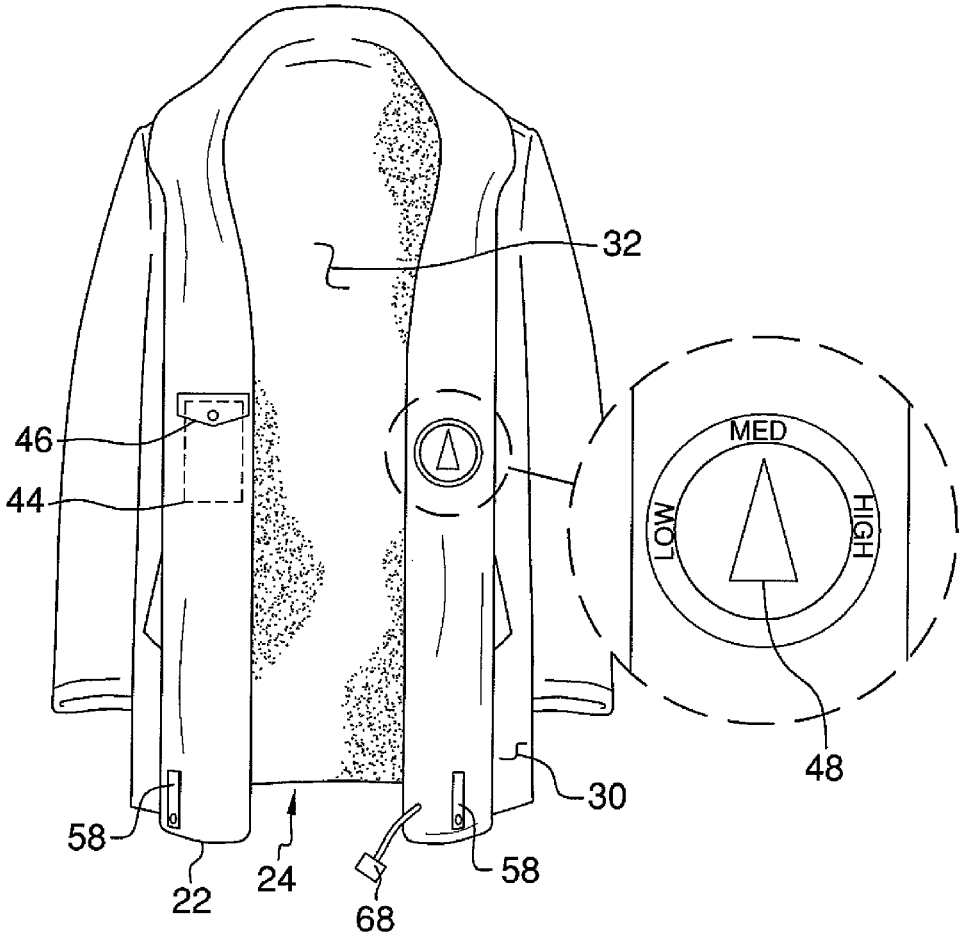
FIG. 4 is a front view of an embodiment of the disclosure.
Figure 5:
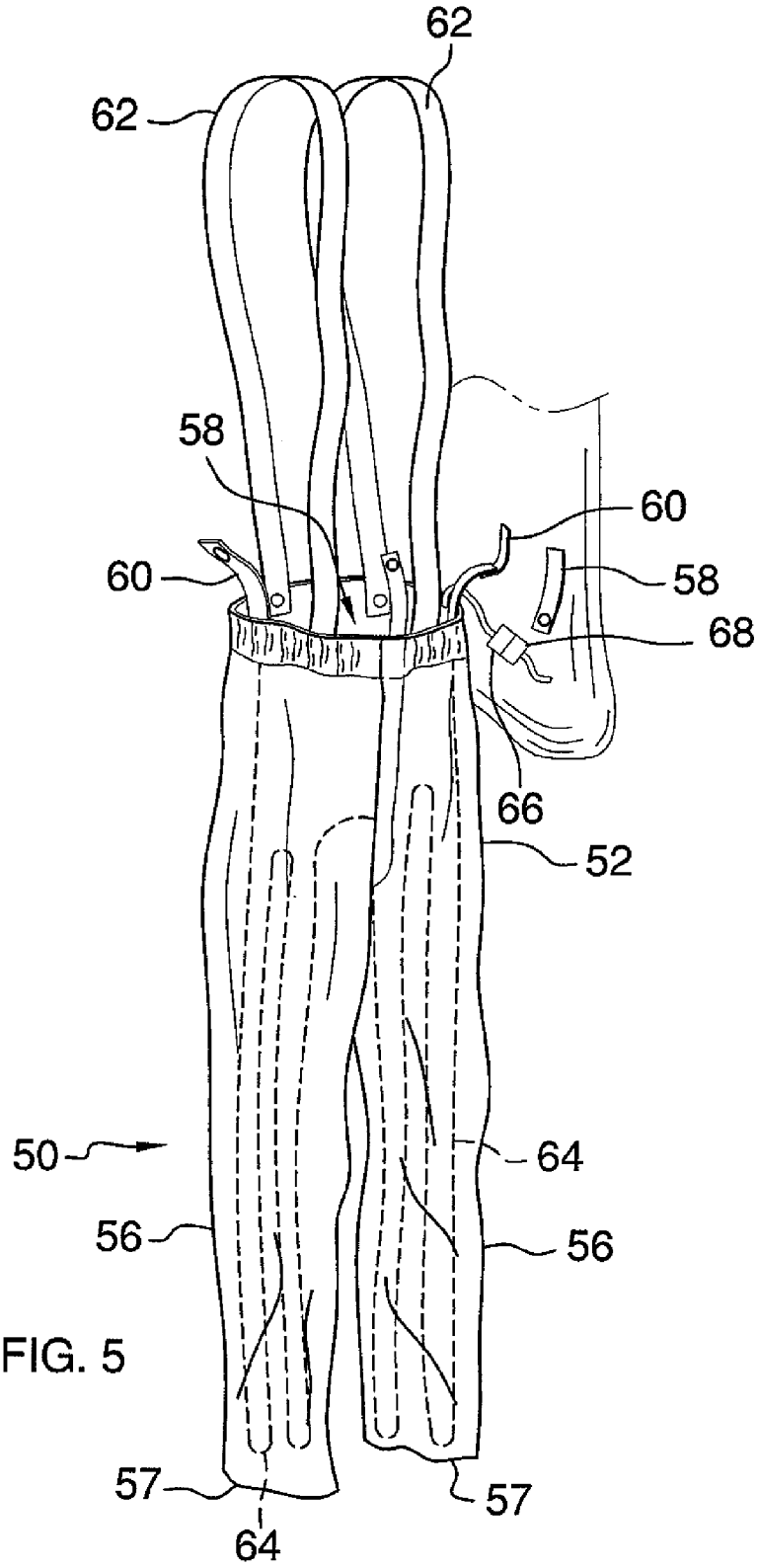
FIG. 5 is a front broken perspective view of an embodiment of the disclosure.

With reference now to the drawings, and in particular to FIGS. 1 through 7 thereof, a new heated garment device embodying the principles and concepts of an embodiment of the disclosure and generally designated by the reference numeral 10 will be described.

As best illustrated in FIGS. 1 through 7, the heated garment assembly 10 generally comprises a jacket 12 that includes a front panel 14 and a rear panel 16 integrally coupled together. The front 14 and rear 16 panels each has an upper edge 18 defining a neck opening 20 and a lower edge 22 defining a body opening 24. The front panel 14 has a slit 26 therein extending between and through the neck 20 and body 24 openings. A pair of sleeves 28 is attached to the jacket 12 and positioned on opposite sides of the jacket 12. The front 14 and rear 16 panels, and the sleeves 28, include an inner layer 30 and an outer layer 32. An insulating material 33 is positioned between the inner 30 and outer 32 layers. The front panel 14 may include hand pockets 34 for a person to extend their hands into while a hood pocket 36 may extend into the rear panel 16 adjacent to the neck opening 20 and which holds an extendable hood 38 for covering a person's head. The slit 26 may be closed by conventional means such as a zipper or snaps.

A heat emitter 40 is mounted in the jacket. The heat emitter 40 includes a plurality of upper heating elements 42. The upper heating elements 42 extend through the rear panel 16, the front panel 14 and each of the sleeves 28. The upper heating elements 42 are positioned between the inner 30 and outer 32 layers. A power supply 44 is electrically coupled coupled to the upper heating elements 42. The power supply 44 is mounted in the jacket 12 and may comprise at least one battery. The at least one battery is mounted in an inner pocket 46 of the jacket 12 so that it can be removed to be recharged or replaced as needed. A control 48 is electrically coupled to the power supply 44 to selectively turn the heating elements 42 on or off. The control 48 includes a thermostat to regulate a temperature of the upper heating elements. The thermostat may either include relative settings such as high, low, etc., or it may include a temperature control for setting a specific temperature between the inner 30 and outer 32 layers.

A pair of pants 50 is provided and includes a lower torso covering 52 having a waist opening 54 and a pair of leg coverings 56 that are attached to and extend downwardly from the torso covering 52. The waist opening 54 may be bounded by an elastic band and the leg coverings 56 are generally oversized to allow them to be pulled over pants being worn by a user of the assembly 10. Each of the leg coverings 56 has a lower end 57 that is open. A plurality of fastening members releasably fastens the lower torso covering 52 to the jacket 12. The fastening members each include a first mating member 58 that is attached to the jacket 12 adjacent to the body opening 24 and a second mating member 60 that is attached to the pants 50 adjacent to the waist opening 54. The first 58 and second 60 mating members may each include straps attached to the associated jacket 12 or pair of pans 50. The straps have either male or female snaps thereon. Suspenders 62 may be attached to the pair of pants 50 to assist in retaining them on a person.

A plurality of lower heating elements 64 is positioned in the pants 50 and extends along a length of the leg coverings 56. The lower heating elements 64 are electrically coupled to a first coupler 66. A second coupler 68 is electrically coupled to the power supply 44. The second coupler 68 is removably coupled to the first coupler 66 to electrically couple together the power supply 44 and the control 48 to the lower heating elements 64 to allow the control 48 to turn on or turn off the lower heating elements 64.

In use, the jacket 12 and the pair of pants 50 are worn in a conventional manner to keep a person warm. However, the upper 42 and lower 64 heating elements may be used as needed to further warm a person. The use of the jacket 12 and pants 50 allows a person to freely move, such as while working in a cold environment. The control 48 may take the form of a dial mounted on an inner surface of the jacket 12 adjacent to the slit 26.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A garment assembly comprising:

a jacket including a front panel and a rear panel integrally coupled together, said front and rear panels each having an upper edge defining a neck opening and a lower edge defining a body opening, said front panel having a slit therein extending between and through said neck and body openings, a pair of sleeves being attached to said jacket and positioned on opposite sides of said jacket, said front and rear panels including an inner layer and an outer layer;

a heat emitter being mounted in said jacket, said heat emitter including;

a plurality of upper heating elements, said upper heating elements extending through said rear panel, said front panel and each of said sleeves, said upper heating elements being positioned between said inner and outer layers;

a power supply being electrically coupled to said upper heating elements; and a control being electrically coupled to said power supply to selectively turn said heating elements on or off a pair of pants including a lower torso covering having a waist opening and a pair of leg coverings being attached to and extending downwardly from said torso covering, each of said leg coverings having a lower end being open;

a plurality of fastening members releasably fastening said lower torso covering to said jacket;

a plurality of lower heating elements being positioned in said pants and extending along a length of said leg coverings, said lower heating elements being electrically coupled to a first coupler;

and a second coupler being electrically coupled to said power supply, said second coupler being removably coupled to said first coupler to electrically couple together said power supply and said control to said lower heating elements to allow said control to turn on or turn off said lower heating elements.

2. The assembly according to claim 1, further including an insulating material being positioned between said inner and outer layers.

3. The assembly according to claim 1, wherein said control includes a thermostat to regulate a temperature of said upper heating elements.

4. A garment assembly comprising:

a jacket including a front panel and a rear panel integrally coupled together, said front and rear panels each having an upper edge defining a neck opening and a lower edge defining a body opening, said front panel having a slit therein extending between and through said neck and body openings, a pair of sleeves being attached to said jacket and positioned on opposite sides of said jacket, said front and rear panels including an inner layer and an outer layer, an insulating material being positioned between said inner and outer layers;

a heat emitter being mounted in said jacket, said heat emitter including;

a plurality of upper heating elements, said upper heating elements extending through said rear panel, said front panel and each of said sleeves, said upper heating elements being positioned between said inner and outer layers;

a power supply being electrically coupled to said upper heating elements, said power supply being mounted in said jacket, said power comprising at least one battery, said at least one battery being mounted in an inner pocket of said jacket;

a control being electrically coupled to said power supply to selectively turn said heating elements on or off, said control including a thermostat to regulate a temperature of said upper heating elements;

a pair of pants including a lower torso covering having a waist opening and a pair of leg coverings being attached to and extending downwardly from said torso covering, each of said leg coverings having a lower end being open;

a plurality of fastening members releasably fastening said lower torso covering to said jacket, said fastening members each including a first mating member being attached to said jacket adjacent to said body opening and a second mating member being attached to said pants adjacent to said waist opening;

a plurality of lower heating elements being positioned in said pants and extending along a length of said leg coverings, said lower heating elements being electrically coupled to a first coupler; and a second coupler being electrically coupled to said power supply, said second coupler being removably coupled to said first coupler to electrically couple together said power supply and said control to said lower heating elements to allow said control to turn on or turn off said lower heating elements.

* * * * *